United States Patent [19]

Cho et al.

[11] Patent Number: 4,884,662

[45] Date of Patent: Dec. 5, 1989

[54] DRIVER INTERACTION SERVICE CENTER AND METHOD OF OPERATING SUCH A CENTER

[75] Inventors: David Cho; Richard M. Steckler, both of Los Angeles, Calif.

[73] Assignee: Carousel Commons, Beverly Hills, Calif.

[21] Appl. No.: 175,106

[22] Filed: Mar. 30, 1988

[51] Int. Cl.[4] ..... E04H 3/04

[52] U.S. Cl. ..... 186/36; 186/41; 52/174

[58] Field of Search ..... 186/36, 37, 41, 53; 52/33, 174, 175, 176; D 25/3, 4, 32

[56] References Cited

U.S. PATENT DOCUMENTS

| | | | |
|---|---|---|---|
| D. 227,456 | 6/1973 | Fulmer | D 25/4 |
| D. 231,778 | 6/1974 | Glasbrenner . | |
| D. 273,228 | 3/1984 | Cotton . | |
| 2,200,639 | 5/1940 | Rice | 52/174 X |
| 2,638,636 | 5/1953 | Pool | 186/53 X |
| 2,827,130 | 3/1958 | Daifotes | 186/41 |
| 3,562,984 | 2/1971 | Merle et al. | 52/175 |
| 3,572,619 | 3/1971 | Brown . | |
| 3,774,723 | 11/1973 | Johnston | 186/36 |
| 4,353,699 | 10/1982 | Johnson . | |
| 4,733,754 | 3/1988 | Acosta | 186/41 X |
| 4,805,738 | 2/1989 | Vayda | 186/36 |

*Primary Examiner*—F. J. Bartuska
*Attorney, Agent, or Firm*—Pretty Schroeder Brueggemann & Clark

[57] ABSTRACT

A driver interaction center, and a method of operating such a center, which includes a driver service dispensation structure, having a plurality of collection stations for dispensing services, and a plurality of driveways, each of which is arrayed adjacent to at least one of the collection stations and which is directionally oriented for tandem collection of the services at the driver's side of vehicles such that drivers need not have to leave their seats to collect the services. Each of the driveways further defines a drive-thru periphery that is situated along the driver's side of vehicles as the vehicles proceed along the given driveway. The driver interaction center can be a food court center, a bank center, a photography center, as well as any of a number of other centers which provide goods or services on a drive-thru basis or have a combination of counter sevice and drive-thru service. In "left-side-driver" countries, such as the United States, each of the driveways is a "right-turn-left-side-driver-specific" driveway. Conversely, in "right-side-driver" countries, such as Great Britain and Japan, each of the driveways is a "left-turn-right-side-driver-specific" driveway.

35 Claims, 3 Drawing Sheets

DRIVER INTERACTION SERVICE CENTER AND METHOD OF OPERATING SUCH A CENTER

FIELD OF THE INVENTION

This invention relates generally to driver interaction service centers, such as drive-thru food and beverage service centers, drive-thru banks, drive-thru photography centers and the like and, more particularly, to a type of driver interaction service center, and to a method of operating such a center, which has facilities that dispense both drive-thru service and counter service and has an array of driveways for providing drive-thru service.

BACKGROUND OF THE INVENTION

Over the years, the escalating monetary value of land and the relative scarcity of premium land for real estate developmental purposes has spawned a need for land to be used as economically as possible. This need has tended to become increasingly acute with respect to service centers, such as certain fast-food restaurants and banks, which have land-intensive drive-thru service facilities. By way of example, a demand has arisen among real estate developers for an efficient and cost-effective way to cluster drive-thru service and counter service fast-food restaurants at "free-standing" locations (i.e. an area which is not occupied by an adjacent shopping mall or other development) or within the vicinity of shopping centers. In a partial effort to satisfy this demand in the shopping mall arena, designers have evolved and implemented the concept of a food court.

The food court usually includes a cluster of restaurants, particularly fast-food restaurants, that dispense food and beverages on a counter service basis. It tends to be located within an area of the mall which is easily accessible to patrons and strategically situated so as to capitalize on patron traffic generated by the anchor stores of the mall.

While the food court has enjoyed considerable success, it has also precipitated a new and unfulfilled demand among mall patrons, proprietors and real estate developers for a food court that has not only counter service, but also drive-thru, capability and which can be effectively situated at "free-standing" locations as well as shopping malls. That is, a substantial number of patrons have an innate penchant for the drive-thru food and beverage service generally provided by an isolated fast-food restaurant that is separately situated at a "free-standing" location. So too with proprietors of fast-food restaurants who typically receive 40 to 60% of their gross sales from drive-thru transactions. Consequently, fast-food restaurant proprietors who are contemplating participation in a pure counter service food court within or near a mall or simply in a pure counter service "free-standing" food court, as opposed to opting for an isolated restaurant at a "free-standing" location, face the prospect of losing a substantial amount of business.

As is well-known, the drive-thru facilities conventionally associated with an isolated fast-food restaurant situated at a "free-standing" location include a vehicular driveway having a menu board, an ordering station, and a collection station located at some point along the driveway. While this arrangement has been successful in dispensing food on a drive-thru basis, it is for all practical purposes unsuitable for use with food courts since it tends to result in a highly inefficient use of land and prohibitively expensive developmental costs. This arrangement would also tend to be equally unsuitable with respect to a cluster of drive-thru banks or with respect to a single bank having multiple stations (i.e. drive-thru teller windows) for providing drive-thru services.

These impediments stem largely from the fact that in "left-side-driver" countries, such as the United States, the driveway conventionally associated with a given "free-standing" fast-food restaurant, or with a given drive-thru bank or the like, is "left-turn-left-side-driver-specific." In the case of a restaurant, for example, a drive-thru patron at a restaurant in such countries typically travels in a counterclockwise direction around a single free-standing restaurant structure, selecting, ordering and collecting his or her food. As such, the periphery of the driveway is situated along the passenger's side of the vehicle as it proceeds through the driveway. This pattern of travel permits the menu board, ordering station and drive-thru collection station all to be situated on the driver's side of the vehicle, thereby making it unnecessary for the patron to leave the driver's seat of the vehicle during any part of the drive-thru process. It also tends to provide for a more efficient tandem traffic pattern among vehicles as they proceed through the drive-thru facility. The geometric properties associated with a "left-turn-left-side-driver-specific" driveway, however, tend to greatly increase the amount of space required for a mall or a "free-standing" location to accommodate a food court containing fast-food restaurants that have both drive-thru and counter service capabilities.

Similar impediments ensue in "right-side-driver" countries, such as Great Britain and Japan, where the driveway conventionally associated with a given "free-standing" fast-food restaurant (or with a given drive-thru bank or the like) is "right-turn-right-side-driver-specific." For example, a drive-thru patron at a restaurant of this nature typically travels in his or her vehicle in a clockwise direction between selecting, ordering and collecting his or her cuisine. This pattern of travel again results in the menu board, ordering station and drive-thru collection station to be situated on the driver's side of the vehicle with advantages and disadvantages similar to that described above for "left-side-driver" countries.

It will be understood that the term "left-turn-left-side-driver-specific" refers to the situation where the driver's side of the vehicle is situated on the vehicle's left side as observed from the frame of reference of an observer seated inside the vehicle and looking toward the vehicle's dashboard. Conversely, the term "right-turn-right-side-driver-specific" refers to the case where the driver's side of the vehicle is situated on the vehicle's right side as observed from the frame of reference of an observer seated inside the vehicle and looking toward the vehicle's dashboard.

It should, therefore, be appreciated that there has existed a definite need in both "left-side-driver" and "right-side-driver" countries for a driver interaction center, and for a method of operating such a center, which has facilities that provide both counter service and drive-thru service without at the same time unacceptably increasing traffic congestion, necessitating prohibitively large additional monetary expenditures, causing a highly uneconomical use of available land, or requiring the driver seeking drive-thru service to leave his seat during any point of the drive-thru process.

SUMMARY OF THE INVENTION

The present invention which addresses this need is embodied in a driver interaction center, and a method of operating such a center, which includes a driver service dispensation structure, having a plurality of collection stations for dispensing services, and a plurality of driveways, each of which is arrayed adjacent to at least one of the collection stations and which is directionally oriented for tandem collection of the services at the driver's side of vehicles such that drivers need not have to leave their seats to collect the services. Consequently the interaction center tends to promote a highly economical and efficient use of land and construction materials. Each of the driveways further defines a drive-thru periphery that is situated along the driver's side of vehicles as the vehicles proceed along the given driveway. The driver interaction center can be a food court center, a bank center, a photography center, as well as any of a number of other centers which provide goods or services on a drive-thru basis or have a combination of counter service and drive-thru service.

More particularly and in the case of a food court center, the service dispensation structure includes a food court. The food court includes a plurality of restaurants, each of which has at least one of the aforementioned collection stations associated with it for the purpose of dispensing food and beverages on a drive-thru basis to drivers of vehicles from the driver's side of said vehicles. Each of the aforementioned driveways is in turn arrayed adjacent to at least one of the restaurants.

In "left-side-driver" countries, such as the United States, each of the driveways is a "right-turn-left-side-driver-specific" driveway. That is to say, as vehicles proceed in tandem through any one of the driveways to collect food and beverages from the driveway's corresponding restaurant, they execute a continuous right or clockwise turn through the driveway. As such, each driveway is directionally oriented to receive at its entrance traffic moving in a clockwise tandem traffic pattern. Conversely, in "right-side-driver" countries, such as Great Britain and Japan, each of the driveways is a "left-turn-right-side-driver-specific" driveway. That is to say, as vehicles proceed in tandem through any one of the driveways to collect food and beverages from that driveway's corresponding restaurant, they execute a continuous left or counterclockwise turn through the driveway. As such, each driveway is directionally oriented to receive at its entrance traffic moving in a counterclockwise tandem traffic pattern. In both "left-side-driver" and "right-side-driver" countries, each of the driveways can include a drive-thru lane which surrounds a median and vehicular ports for temporary parking that are juxtaposed to the median. The driveways can also be approximately circular such that vehicles execute substantially a complete circle between exiting and entering the driveways.

In more detailed aspects of the invention, the food court center includes a plurality of vehicular stacking lanes, each of which has a median strip located along the driver's side of vehicles. Additionally, a menu board for selecting food and beverages and visible from vehicles moving along its corresponding driveway, and an ordering station for ordering food and beverages are situated on the median strip. Each stacking lane is juxtaposed to one of the driveways and feeds into that corresponding driveway. Each stacking lane is also directionally oriented for tandem selection and ordering of food and beverages from the driver's side of vehicles such that drivers of vehicles need not have to leave their seats to select and order food and beverages. In "left-side-driver" countries, each stacking lane is further directionally oriented to receive traffic moving along a clockwise tandem traffic pattern. That is to say, vehicles line up in the stacking lanes so as to foster a clockwise tandem traffic flow upon exiting the stacking lanes and entering their corresponding driveways. Conversely, in "right-side-driver" countries, each stacking lane is further directionally oriented to receive traffic moving along a counterclockwise tandem traffic pattern. That is to say, vehicles line up in the stacking lane so as to foster a counterclockwise tandem traffic pattern.

In still more detailed aspects of the invention, the food court center includes a track which at least partially surrounds the food court and the driveways. The track includes a vehicular transit lane and a sidewalk located adjacent to the transit lane. The transit lane is arranged for access to and egress from the driveways by vehicles and allows the vehicles to travel between the driveways.

The transit lane, stacking lanes and driveways are arranged together and arrayed such that they tend to provide for a very efficient method of operating a driver interaction center, such as a food court center. The transit lane tends to ensure that vehicles follow an efficient circulatory traffic pattern about the center. The stacking lanes and driveways foster efficient, sequential diversion of selected vehicles from the transit lane and subsequently cause the diverted vehicles to reenter the transit lane through crossing over a portion of the driveway that such vehicles previously traversed.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The accompanying drawings illustrate the invention. In such drawings.

DESCRIPTION OF THE PREFERRED EMBODIMENT

Figure 1:
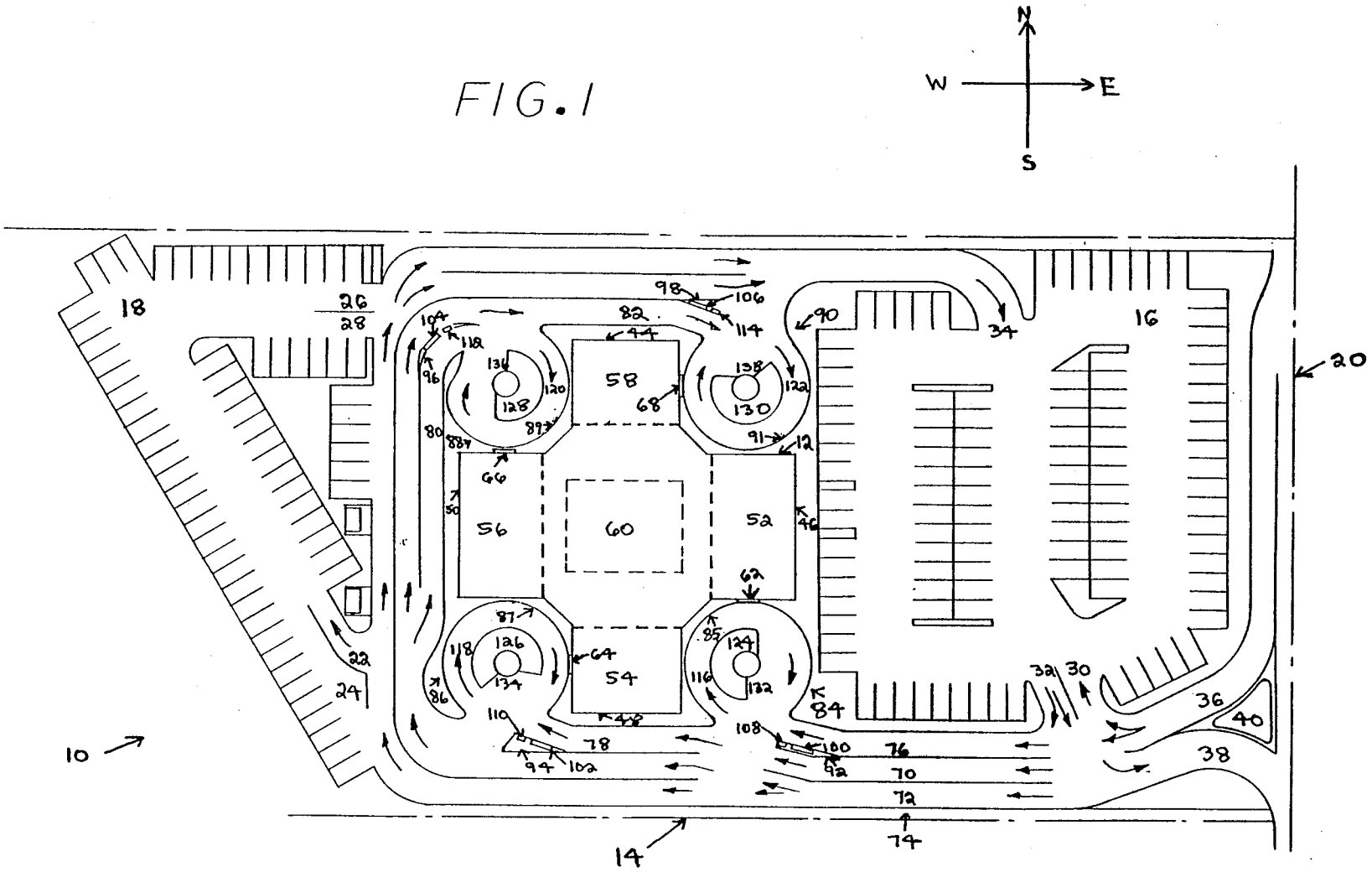
FIG. 1 is a diagrammatic plan view of a preferred embodiment of a drive-thru and counter service food court center of the invention.

With reference now to the drawings, and particularly FIG. 1, there is shown a driver interaction service center in the form of a drive-thru and counter-service food court center 10 constructed according to the present invention. It includes a food court 12, a track 14 for conveying vehicles and pedestrians about the center 10, and two opposing eastern and western parking lots 16 and 18 which are situated respectively along the eastern and western sides of the food court 12 and are separated from each other by it. A public thoroughfare 20 traverses from north to south in proximity to the eastern most side of the eastern parking lot 16. The western parking lot 18 has first and second entrances and exits 22, 24, and 26, 28 located respectively at its southeastern and northeastern corners, while the eastern parking lot 16 has a first entrance and exit 30, and 32 located at its southeastern corner and only a second entrance 34 located at its northeastern corner.

Figure 2:
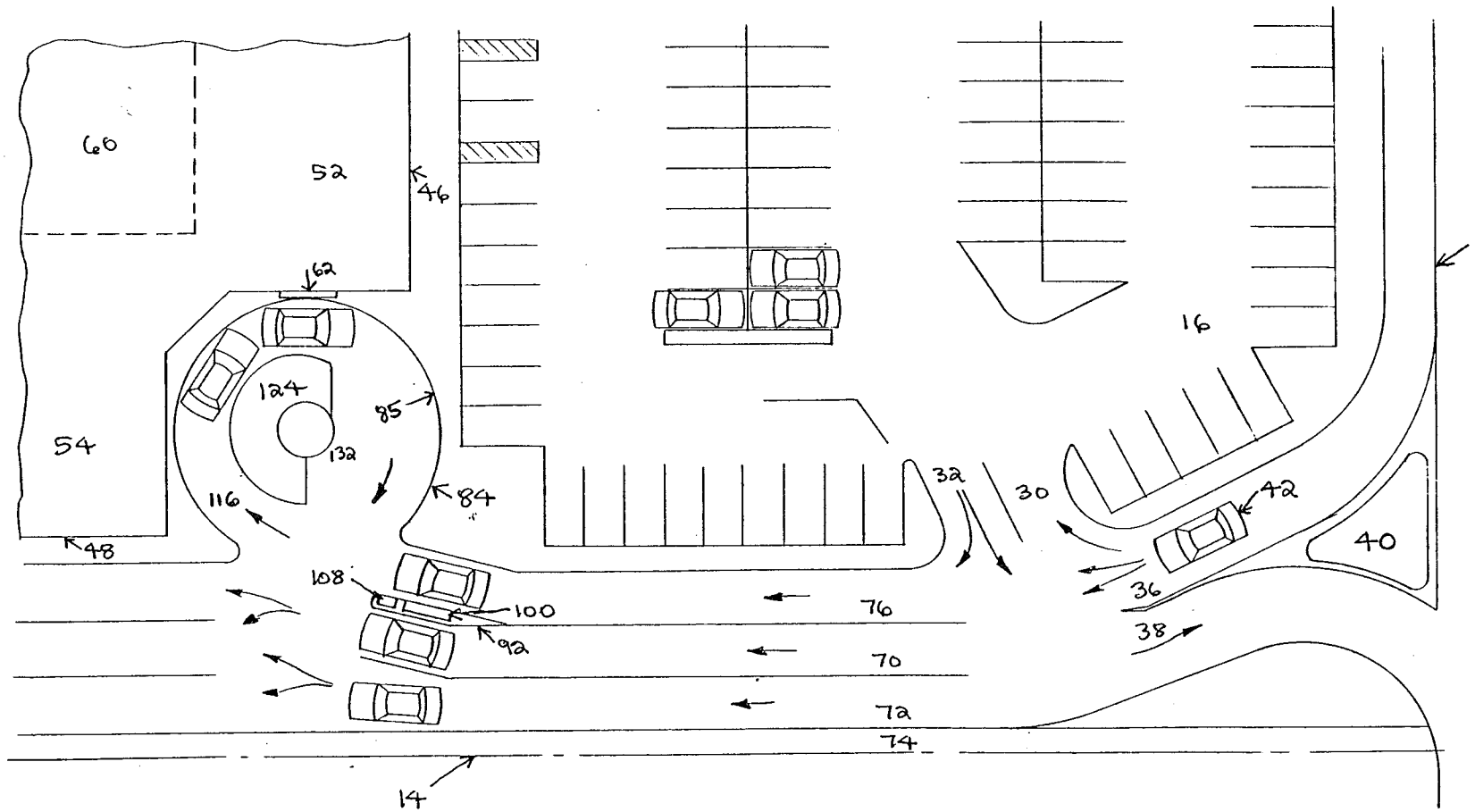
FIG. 2 is an enlarged plan view of the southeast and south-central portions of the food court center of FIG. 1 showing the first right-turn-left-side-driver-specific driveway, and first stacking lane.

For the purpose of allowing entry from the thoroughfare 20 and egress from the food court center 10 onto the thoroughfare 20, the center 10 also has entrance and exit ramps 36 and 38 located at its southeastern corner and adjacent the southeasternmost section of the eastern parking lot 16. The entrance ramp 36 is located nearest the eastern parking lot 16, and curves in a southwesterly to westerly direction as viewed from the frame of reference of a driver of a vehicle travelling south along the thoroughfare 20. The ramps 36 and 38 are partially separated from each other by a Y-shaped first median 40 and have stop signs (not shown) located at their respective termination points. Both the entrance ramp 36 and the exit ramp 38 merge into the track 14. As shown in FIGS. 1 and 2, a vehicle 42 enters the entrance ramp 16 by travelling south along the thoroughfare 20 and then executing a right or clockwise turn onto the ramp 36, thereby proceeding in an increasingly westerly direction as it traverses the entrance ramp 36. Conversely, upon exiting the center 10, the vehicle 42 would traverse the exit ramp 38 in an easterly direction and then execute a right or clockwise turn onto the thoroughfare 20.

It will be appreciated that the food court center 10 shown in FIG. 1, is advantageously, but by no means solely, constructed for inclusion at a "free-standing" location. It can also be utilized in connection with shopping centers. Moreover, the food court center 10 may have a number of differently arrayed parking lots, ramps or tracks.

The food court 12 is a sixteen-sided polygon and configured generally like the longitudinal cross-section of a Greek Cross with first through fourth four primary corner locations: north, east, south, and west primary corners 44, 46, 48, and 50. It includes first through fourth fast-food restaurants 52, 54, 56, and 58 which are disposed around a dining area 60 that has its locus in the center of the food court 12. Each restaurant 52, 54, 56, and 58 occupies one of the first through fourth primary corner locations 46, 48, 50, and 44 respectively. Although not specifically shown in FIG. 1, it will be appreciated that each restaurant 52, 54, 56, and 58 also has internal facilities, such as a kitchen and cash registers, typically employed to provide both drive-thru and counter service capabilities. The drive-thru service capability is evinced by the fact that each restaurant 52, 54, 56, and 58 has a drive-thru, collection station or "pick-up" window 62, 64, 66, and 68 where restaurant employees process and accept payment for culinary orders (i.e. food and beverages) which have been placed on a drive-thru basis. Drive-thru service capability can also be supplemented by known conveyor systems which deliver food and beverages directly to the driver of a given vehicle.

It will be appreciated that food courts having various other geometric configurations can be constructed and that food courts can have any one of several different combinations of drive-thru and non-drive-thru-service fast-food restaurants, or even other types of restaurants, such as more traditional restaurants, whose proprietors opt to provide drive-thru service. The food court can also include a combination of restaurant and non-restaurant structures, such as banks. Moreover, the food court can also have spaces for "sidewalk" vendors of food, beverages and other goods and can be constructed such that it is directly connected to the shopping mall itself.

As shown in FIG. 1, the track 14 includes two inner vehicular transit lanes 70 and 72 and an outer pedestrian sidewalk 74 which runs along portions of the transit lanes 70 and 72. The transit lanes 70 and 72 begin near the southeast corner of the center 10, extend westward along its outer periphery, run in between the western parking lot 18 and the food court 12 in a northerly direction and then merge into the second entrance 34 associated with the northeast corner of the eastern parking lot 16. The transit lanes 70 and 72 also merge into the entrance and exit ramps 36 and 38 and feed into the first and second entrances and exits 22, 24 and 26, 28 of the western parking lot 18 and into the first entrance and exit 30 and 32 of the eastern parking lot 16.

In accordance with the present invention, a preferred embodiment of which is shown in FIG. 1, the food court center 12 includes first through fourth vehicular "stacking lanes" 76, 78, 80, and 82, each of which feeds into one of four corresponding first through fourth "right-turn-left-side-driver-specific" driveways 84, 86, 88, and 90 that provide drive-thru service capability via effectuating a clockwise, tandem traffic pattern both within the driveways 84, 86, 88, and 90 and the center 10 generally. Moreover, the stacking lanes 76, 78, 80, and 82 and driveways 84, 86, 88, and 90 are directionally oriented for the tandem selecting, ordering and collection of food and beverages at the driver's side of the vehicle such that the driver of a vehicle never has to leave his seat during any point of the drive-thru process. Further, the use of the driveways 84, 86, 88, and 90 with corresponding stacking lanes 76, 78, 80, and 82 tends to allow the economical and efficient clustering of fast-food restaurants having both drive-thru and counter-service capabilities and tends to facilitate the development of a smooth, orderly traffic pattern between the restaurants 52, 54, 56, and 58. Overall, the food court center 10 tends to achieve a highly economical and efficient use of space and tends to dramatically reduce the traffic congestion which would otherwise occur.

As shown in FIG. 1, the first through fourth stacking lanes 76, 78, 80, and 82 extend parallel to the transit lanes 70 and 72 for a substantial portion of the stacking lanes' 76, 78, 80, and 82 overall length before curving in a clockwise direction for the purpose of merging into their corresponding driveways 84, 86, 88, and 90. Each stacking lane 76, 78, 80, and 82 includes a stop sign (not shown) situated at its front and a median strip 92, 94, 96, and 98 which is located along the driver's side of a vehicle at the front of the lanes 76, 78, 80, and 82. The stop sign (not shown) ensures that vehicles within the stacking lanes 76, 78, 80, and 82 yield to vehicles exiting the driveways 84, 86, 88, and 90. Each median strip 92, 94, 96, and 98 has a conventional menu board 100, 102, 104, and 106 and an ordering station 108, 110, 112 and 114 where food and beverages are selected and ordered. Additional menu boards (not shown) can also be situated on the passenger's side of a vehicle along each stacking lane 76, 78, 80, and 82.

It will be appreciated that the stacking lanes 76, 78, 80, and 82 provide space for vehicles to align in tandem for the purpose of selecting and ordering food and beverages, thereby tending to reduce traffic congestion with the center. The lanes 76, 78, 80, and 82 are preferably of length adequate enough to accommodate at least ten vehicles aligned bumper-to-bumper as is typically required by municipal zoning laws.

The first through fourth "right-turn-left-side-driver-specific" driveways 84, 86, 88, and 90 advantageously, but by no means necessarily, are substantially circular in shape such that a vehicle has negotiated substantially a 360 degree clockwise turn upon traversing both the entrances and exit portions of each driveway 84, 86, 88, and 90. The vehicle 42, therefore, crosses back over the portion of the driveway 84, 86, 88 and 90 that it originally traversed as it entered the driveway 84, 86, 88 and 90. It will be understood that the aforementioned "cross-over" pattern further promotes economical use of land, and tends to substantially minimize the amount of space required for the driveways 84, 86, 88 and 90 and stacking lanes 76, 78, 80 and 82.

Each of the driveways 84, 86, 88, and 90 defines a drive-thru periphery 85, 87, 89 and 91, which is located along the driver's side of a given vehicle as it proceeds through the driveway 84, 86, 88 and 90. The center of curvature of each driveway 84, 86, 88 and 90, relative to its corresponding drive-thru periphery 85, 87, 89 and 91 is in turn situated nearer to the passenger's side of a given vehicle than to the driver's side. As a result, the amount of space required for the driveways 84, 86, 88 and 90 tends to be minimized. It will be further observed that the driveways 84, 86, 88 and 90 are sequentially arrayed adjacent the transit lanes 70 and 72. Each of the driveways includes a drive-thru lane 116, 118, 120, and 122 which surrounds an ear-shaped median or island 124, 126, 128 and 130. Additionally, some vehicular ports 132, 134, 136, and 138 for temporary parking can be set aside adjacent to each median 124, 126, 128 and 130. The lanes 76, 78, 80, and 82 can also be wide enough to accommodate two vehicles so as to allow for ease of entrance and egress.

As shown in FIG. 1, each of the driveways 84, 86, 88 and 90 is located near two of the four fast-food restaurants 52, 54, 56, and 58 and advantageously occupies one of the four concave spaces formed by the outer periphery of the food court 12. Moreover, as manifested by the locations of their respective collection stations or "pick-up" windows 62, 64, 66, and 68, each driveway 52, 54, 56, and 58 preferably, but not necessarily, accommodates drive-thru service for only a single restaurant 52, 54, 56, and 58 in order to avoid the traffic congestion which might ensue if it served more than one restaurant. Thus, as depicted in FIGS. 1 and 2 the first driveway 84 is associated with the first restaurant 52, the second driveway 86 is associated with the second restaurant 54 and so forth. It will also be observed from FIG. 1 that the existence of a clockwise traffic flow within the driveways 84, 86, 88, and 90 allows the driver of a vehicle to collect and pay for his food at the collection stations 62, 64, 66, and 68 at the driver's side of the vehicle.

It will be appreciated that other driver interaction centers, such as a cluster of drive-thru banks or a drive-thru bank having multiple drive-thru teller windows, can be constructed in accordance with the present invention. In the case of banks, the services provided would be banking services, rather than food and beverage services. Thus, for example, the restaurants 52, 54, 56 and 58 can be a cluster of banks or the collection stations 62, 64, 66 and 68 can correspond to multiple drive-thru teller windows for a single bank.

It will be further appreciated that the present invention is readily adaptable to "right-side-driver" countries, such as Great Britain and Japan, where the driver's side of the vehicle is located on the vehicle's right side as viewed from the frame of reference of an observer seated inside the vehicle and looking toward the vehicle's dashboard. In either case, it will be observed that each drive-thru periphery 85, 87, 89 and 91 corresponding to the driveways 84, 86, 88 and 90 is situated along the driver's side of the vehicle. Thus, in accordance with the present invention in such countries, a counterclockwise, rather than clockwise, traffic pattern would ensue within the drive-thru and counter-service food court center. This would permit selection, ordering and collection of food and beverages to completely occur at the driver's side of the vehicle and tend to achieve the same economies of space and minimization of traffic congestion attained in "left-side-driver" countries.

Figure 3:
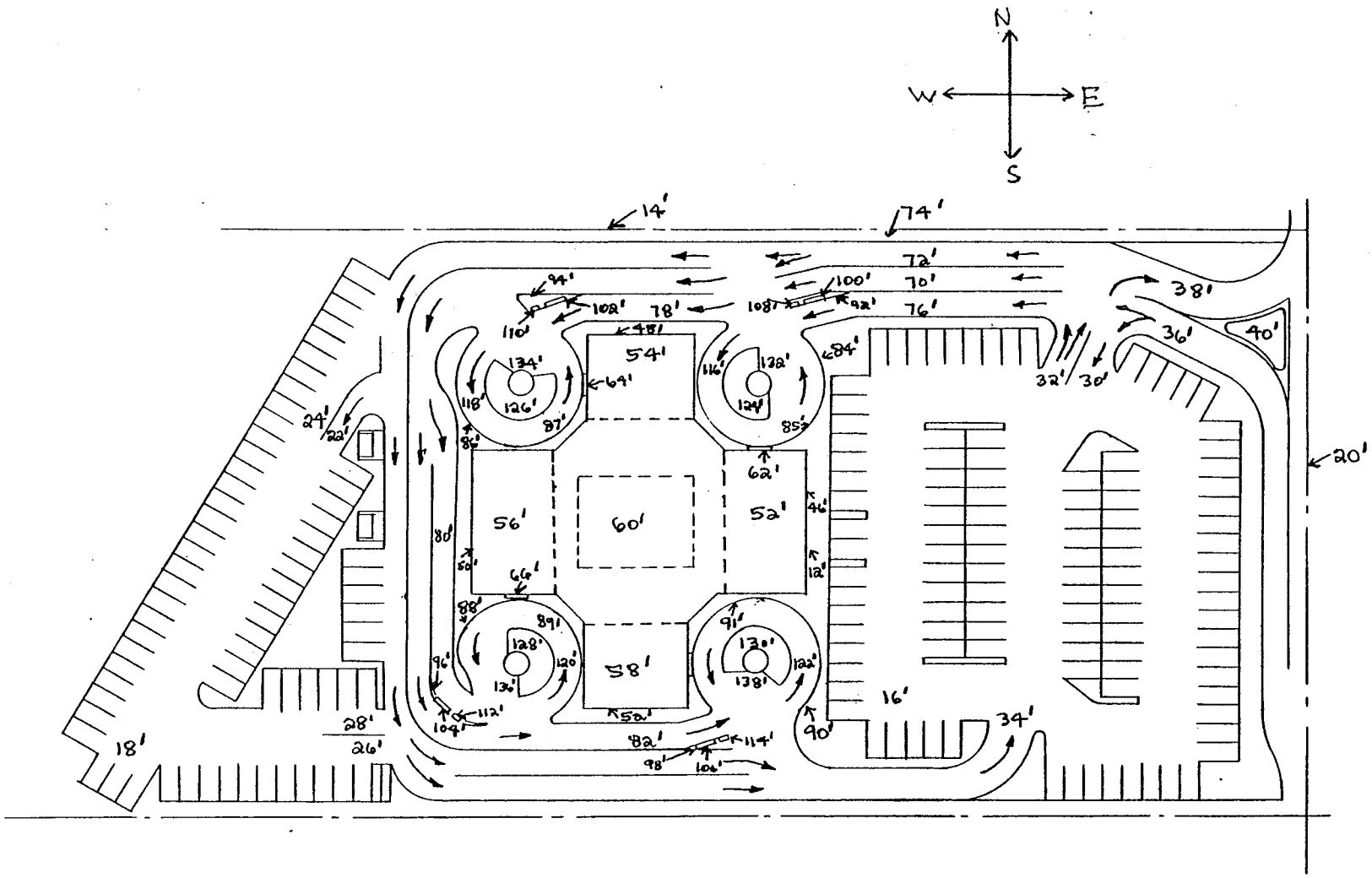
FIG. 3 is an inverted diagrammatic plan view of the drive-thru and counter service food court center embodiment of the present invention shown in FIG. 1.

More specifically, FIG. 3 depicts an inverted plan diagram of the plan diagram of FIG. 1 and shows the preferred embodiment of the present invention adapted for "right-side-driver" countries. As shown in FIG. 3, a counterclockwise, traffic pattern now ensues within the transit lanes 70' and 72' and the stacking lanes 76', 78', 80', and 82', and driveways 84', 86', 88', and 90'. The driveways are thus "left-turn-right-side-driver-specific" driveways. Moreover, the entrance ramp 36 now serves as an exit ramp 38'. Conversely, the exit ramp 38 now functions as an entrance ramp 36'. It will also be observed that the entrance and exit ramps 36' and 38' are now situated at the northeast corner of the center 10 and that vehicles enter the entrance ramp 36' after travelling north along the thoroughfare 20'. It will, therefore, be appreciated that reference to the word "clockwise" herein means "counterclockwise" in "right-side-driver" countries. Similarly, reference to the term "right turn" means "left turn" in such countries.

The drive-thru process for the food court center 10 in "left-side-driver" countries will now be discussed with reference to FIGS. 1 and 2 and, particularly, with the aid of the directional arrows contained in FIGS. 1 and 2. It will, however, be understood that an essentially similar overall process ensues in "right-side-driver" countries, except that a counterclockwise traffic pattern results. A vehicle 42 travelling south along the public thoroughfare 20 enters the center 10 via executing a clockwise turn onto the entrance ramp 36. Upon reaching the termination of the ramp 36, the vehicle 42 stops at the stop sign (not shown), at which time its driver (not shown) has the option of executing a right turn into the eastern parking lot 16 through the lot's first entrance 30 or entering either of the transit lanes 70, and 72 of the track 14. In the former case, the driver will have effectively opted for counter service from one or more of the fast-food restaurants 52, 54, 56, and 58.

As the vehicle 42 traverses either of the transit lanes 70 or 72 in a westerly direction, the vehicle 42 comes upon the first stacking lane 76 associated with the first "right-turn-left-side-driver-specific" driveway 84 which is in turn associated with the first fast-food restaurant 52. In the event that the driver opts for drive-thru service at the first restaurant 52, the driver simply exits his or her chosen transit lane 70 and 72 and enters the first stacking lane 76. As shown in FIG. 2, the vehicle 42 then proceeds along the first stacking lane 76, typically in tandem with other vehicles (not shown) until it reaches the section of the median strip 92 where the menu board 100 and ordering station 108 are located. There, the driver of the vehicle 42 selects food or beverages and places an order at the driver's side of the vehicle 42 in the conventional manner. Afterwards, the driver stops the vehicle 42 at the stop sign (not shown), so as to yield to other vehicles exiting from the first driveway 84.

The vehicle 42 then enters the first driveway 84 and executes a clockwise turn such that the ear-shaped median 124 is located on the passenger's side of the vehicle 42 and the drive-thru periphery 85 of the driveway is located along the driver's side of the vehicle. As the vehicle 42 reaches approximately the midpoint of its journey, it arrives at the collection station or "pick-up" window 62 associated with the first fast-food restaurant 52. There, the driver collects and pays for his or her order at the driver's side of the vehicle 42. Afterwards, the vehicle continues along the first driveway 84 in a clockwise direction and merges into either transit lane 70 and 72 in a westerly direction upon exiting the first driveway 84. It will be observed that the entire process of selecting, ordering and collecting of food and beverages is conducted at the driver's side of the vehicle and without any need for the driver to leave his or her seat.

In the event that the driver opts for drive-thru service at the second fast-food restaurant 54, he or she again exits either of the transit lanes 70 and 72 and enters the second stacking lane 78. In a like manner to that described above, the driver then selects and orders food or beverages, again executes an approximately 360 degree clockwise turn around the second driveway 86 and merges the vehicle 42 back into either transit lane 70 and 72 in a clockwise direction.

Upon merging into either transit lane 70 and 72, the vehicle 42 executes a clockwise or right turn such that its direction of travel is now a northerly, rather than westerly, one. At that time, the driver has the option of continuing along either transit lane 70 and 72 toward the third driveway 88 or entering the western parking lot 18 at the first entrance 22 located at the lot's 18 southeast corner. Alternatively, vehicles currently parked in the western parking lot 18 for the purpose of obtaining counter service, can exit the lot 18 at its first exit 24 located at the lot's 18 southeast corner by executing a left turn onto the transit lane 72. It will be observed that the aforementioned requirement of a left turn ensures that the traffic flow pattern ensuing within the track 14 and within the first through fourth driveways 84, 86, 88, and 90 is always clockwise in nature.

In the event that the driver continues along either transit lane 70 and 72, he or she can opt for drive-thru service at the third fast-food restaurant 56 through simply proceeding through the third stacking lane 80 and third driveway 88 in the manner described above. Alternatively, the driver can decide to forego drive-thru service at the third restaurant 56 and seek counter service through executing a left turn from the transit lane 72 into western parking lot 18 through the lot's 18 second entrance 26 located at the lot's 18 northwest corner. Or, the driver can forego either parking or drive-thru service and continue along either transit lane 70 and 72 through execution of a clockwise north to east turn. He or she then can seek drive-thru service at the fourth fast-food restaurant 58 or forego drive-thru service and enter the eastern parking lot 16 through the lot's 34 second entrance located at the lot's 16 northeast corner for the purpose of seeking counter service at one or more of the restaurants 52, 54, 56, and 58. Alternatively, the driver of the vehicle 42 can exit the food court center 10 by making a left turn from the first exit 32, located at the lot's 16 southeastern corner, onto the exit ramp 38. It will be observed that in order to preserve the clockwise traffic flow pattern within the track 14 the northeastern corner of the parking lot has an entrance 34 but no exit.

Although the invention has been described in detail with reference to the presently preferred embodiment, it will be appreciated by those skilled in the art that various modifications can be made without departing from the spirit and scope of the invention. Accordingly, the invention is limited only by the following claims.

We claim:

1. A driver interaction service center, comprising:

a driver service dispensing structure having a plurality of collection stations for dispensing services on a drive-thru basis to drivers of vehicles at the driver's side of said vehicles; and a plurality of driveways for use by said vehicles, each of said driveways including an entrance portion and an exit portion, said driveways being arrayed so that each is adjacent to at least one of said collection stations and is directionally oriented for tandem collection of said services by said drivers of said vehicles at said driver's side of said vehicles, each of said driveways defining a circulatory drive-thru periphery that is situated along said driver's side of said vehicles with each driveway having a center of curvature situated nearer to the passenger's side of a given vehicle than to the driver's, each of said driveways being arranged for a circulatory traffic flow pattern between said entrance portion and said exit portion that is characterized by a cross-over traffic flow pattern upon completion of said circulatory pattern;

whereby each of said vehicles, after passing any one of said collection stations, completes said circulatory pattern by crossing over a portion of said driveway that it has previously traversed.

2. The driver interaction service center of claim 1, wherein each of said driveways is a right-turn-left-side-driver-specific driveway directionally oriented to receive at said entrance portion traffic moving in a clockwise tandem traffic pattern between said entrance portion and said exit portion.

3. The driver interaction service center of claim 1, wherein each of said driveways is a left-turn-right-side-driver-specific driveway directionally oriented to receive at said entrance portion traffic moving in a counterclockwise tandem traffic pattern between said entrance portion and said exit portion.

4. The driver interaction service center of claim 1, wherein each of said driveways includes:

a median;

a drive-thru lane surrounding said median; and vehicular ports for temporary parking juxtaposed to said median.

5. The driver interaction service center of claim 1, wherein each of said driveways is approximately circular and defines a substantially complete circle between each of said entrance and exit portions corresponding to each of said driveways.

6. The driver interaction service center of claim 1, further including a track at least partially surrounding said driver interaction service center and said driveways, said track including:

(a) a vehicular transit lane arranged for access to and egress from said driveways by said vehicles and arranged for travel between said driveways by said vehicles; and (b) a sidewalk located adjacent to said transit lane.

7. The driver interaction center of claim 1, wherein:

said driver service dispensation structure includes a food court having a plurality of restaurants, each of which has at least one of said collection stations associated with it; and said services are food and beverages.

8. The driver interaction service center of claim 7, further including a plurality of vehicular stacking lanes, each of which is juxtaposed to one of said driveways and feeds into one of said driveways, each of said stacking lanes being directionally oriented for tandem selection and ordering of said food and beverages by said drivers of said vehicles at said driver's side of said vehicles.

9. The driver interaction service center of claim 8, wherein each of said stacking lanes is further directionally oriented to receive traffic moving along a clockwise tandem traffic pattern.

10. The driver interaction service center of claim 8, wherein each of said stacking lanes is further directionally oriented to receive traffic moving along a counterclockwise tandem traffic pattern.

11. The driver interaction service court of claim 8, wherein each of said stacking lanes includes:

a median strip located along the driver's side of said vehicles;

a menu board situated on said median strip and visible from vehicles moving along its corresponding stacking lane; and an ordering station situated on said median strip.

12. A food court center, comprising:

a food court, including a plurality of restaurants each having a collection station for dispensing food and beverages on a drive-thru basis to drivers of vehicles at the driver's side of said vehicles; and a plurality of driveways for use by said vehicles, each of said driveways including an entrance portion and an exit portion, said driveways being arrayed so that each is adjacent to at least one of said restaurants, each of said driveways defining a circulatory drive-thru periphery that is situated along said driver's side of said vehicles with each driveway having a center of curvature situated nearer to the passenger's side of a given vehicle than to the driver's side, each of said driveways being arranged for a circulatory traffic flow pattern between said entrance portion and said exit portion that is characterized by a cross-over traffic flow pattern upon completion of said circulatory pattern, each of said driveways being directionally oriented for tandem collection of said food and beverages by said drivers of said vehicles at said driver's side of said vehicles; and whereby each of said vehicles, after passing any one of said collection stations, completes said circulatory traffic pattern by crossing over a portion of said driveway that it has previously traversed.

13. The food court center of claim 12, wherein each of said driveways is a right-turn-left-side-driver-specific driveway directionally oriented to receive at said entrance portion traffic moving in a clockwise tandem traffic pattern between said entrance portion and said exit portion.

14. The food court center of claim 12, wherein each of said driveways is a left-turn-right-side-driver-specific driveway directionally oriented to receive at said entrance portion traffic moving in a counterclockwise tandem traffic pattern between said entrance portion and said exit portion.

15. The food court center of claim 12, wherein each of said driveways includes:

a median;

a drive-thru lane surrounding said median; and vehicular ports for temporary parking juxtaposed to said median.

16. The food court center of claim 12, wherein each of said driveways is approximately circular and defines a substantially complete circle between each of said entrance and exit portions corresponding to each of said driveways.

17. The food court center of claim 12, further including a plurality of vehicular stacking lanes, each of which is juxtaposed to one of said driveways and feeds into one of said driveways, each of said stacking lanes being directionally oriented for tandem selection and ordering of said food and beverages by said drivers of said vehicles at said driver's side of said vehicles.

18. The food court center of claim 17, wherein each of said stacking lanes is further directionally oriented to receive traffic moving along a clockwise tandem traffic pattern.

19. The food court center of claim 17, wherein each of said stacking lanes is further directionally oriented to receive traffic moving along a counterclockwise tandem traffic pattern.

20. The food court center of claim 17, wherein each of said stacking lanes includes:

a median strip located along the driver's side of said vehicles;

a menu board situated on said median strip and visible from vehicles moving along its corresponding stacking lane; and an ordering station situated on said median strip.

21. The food court center of claim 12, further including a track at least partially surrounding said driver interaction service center and said driveways, said track including:

(a) a vehicular transit lane arranged for access to and egress from said driveways by said vehicles and arranged for travel between said driveways by said vehicles; and (b) a sidewalk located adjacent to said transit lane.

22. A food court center, comprising:

a food court, including a plurality of restaurants each having a collection station for dispensing food and beverages on a drive-thru basis to drivers of vehicles at the driver's side of said vehicles; and a plurality of right-turn-lift-side-driver-specific driveways for use by said vehicles, each of said driveways including an entrance portion and an exit portion, said driveways being arrayed so that each is adjacent to at least one of said restaurants, each of said driveways defining a circulatory drive-thru periphery that is situated along said driver's side of said vehicles with each driveway having a center of curvature situated nearer to the passenger's side of a given vehicle than to the driver's side, each of said driveways being arranged to receive at said entrance portion traffic moving in a clockwise circulatory tandem traffic flow pattern between said entrance portion and said exit portion that is characterized by a cross-over traffic flow pattern upon completion of said clockwise circulatory pattern, each of said driveways being directionally oriented for tandem collection of said food and beverages by said drivers of said vehicles at said driver's side of said vehicles; and whereby each of said vehicles, after passing any one of said collection stations, completes said clockwise circulatory pattern by crossing over a portion of said driveway that it has previously traversed.

23. The food court center of claim 22, wherein each of said driveways includes:

a median;

a drive-thru lane surrounding said median; and vehicle ports for temporary vehicular parking juxtaposed to said median.

24. The food court center of claim 22, wherein each of said driveways is approximately circular and defines a substantially complete circle between each of said entrance and exit portions corresponding to each of said driveways.

25. The food court center of claim 22, further including a plurality of vehicular stacking lanes, each of which is juxtaposed to one of said driveways and feeds into one of said driveways, each of said stacking lanes being directionally oriented to receive traffic moving along a clockwise tandem traffic pattern and for tandem selection and ordering of said food and beverages by said drivers of said vehicles at said driver's side of said vehicles.

26. The food court center of claim 25, wherein each of said stacking lanes includes:

a median strip located along the driver's side of said vehicles;

a menu board situated on said median strip and visible from vehicles moving along its corresponding stacking lane; and an ordering station situated on said median strip.

27. The food court center of claim 22, further including a track at least partially surrounding said food court and said driveways, said track including:

(a) a vehicular transit lane arranged for access to and egress from said driveways by said vehicles and for travel between said driveways by said vehicles, said transit lane being adapted for a clockwise tandem traffic pattern; and (b) a sidewalk located adjacent to said transit lane.

28. A food court center, comprising:

a food court, including a plurality of restaurants each having a collection station for dispensing food and beverages on a drive-thru basis to drivers of vehicles at the driver's side of said vehicles; and a plurality of left-turn-right-side-driver-specific driveways for use by said vehicles, each of said driveways including an entrance portion and an exit portion, said driveways being arrayed so that each is adjacent to at least one of said restaurants, each of said driveways defining a circulatory drive-thru periphery that is situated along said driver's side of said vehicles with each driveway having a center of curvature situated nearer to the passenger's side of a given vehicle than to the driver's side, each of said driveways being arranged to receive at said entrance portion traffic moving in a counterclockwise circulatory tandem traffic flow pattern between said entrance portion and said exit portion that is characterized by a cross-over traffic flow pattern upon completion of said counterclockwise circulatory pattern, each of said driveways being directionally oriented for tandem collection of said food and beverages by said drivers of said vehicles at said driver's side of said vehicles; and whereby each of said vehicles, after passing any one of said collection stations, completes said counterclockwise circulatory pattern by crossing over a portion of said driveway that it has previously traversed.

29. The food court center of claim 28, wherein each of said driveways includes:

a median;

a drive-thru lane surrounding said median; and vehicle ports for temporary vehicular parking juxtaposed to said median.

30. The food court center of claim 28, wherein each of said driveways is approximately circular and defines a substantially complete circle between each of said entrance and exit portions corresponding to each of said driveways.

31. The food court center of claim 28, further including a plurality of vehicular stacking lanes, each of which is juxtaposed to one of said driveways and feeds into one of said driveways, each of said stacking lanes being directionally oriented to receive traffic moving along a counterclockwise tandem traffic pattern and for tandem selection and ordering of said food and beverages by said drivers of said vehicles at said driver's side of said vehicles.

32. The food court center of claim 31, wherein each of said stacking lanes includes:

a median strip located along the driver's side of said vehicles;

a menu board situated on said median strip and visible from vehicles moving along its corresponding stacking lane; and an ordering station situated on said median strip.

33. The food court center of claim 28, further including a track at least partially surrounding said food court and said driveways, said track including:

(a) a vehicular transit lane arranged for access to and egress from said driveways by said vehicles and for travel between said driveways by said vehicles, said transit lane being adapted for a counterclockwise tandem traffic pattern, and (b) a sidewalk located adjacent to said transit lane.

34. A method of operating a driver interaction service center, said service center including a plurality of interconnected driver service dispensing structures each having a collection station for dispensing services on a drive-thru basis to drivers of vehicles at the driver's side of said vehicles, said method comprising the steps of:

causing said vehicles to follow a vehicular transit lane that at least partially surrounds said service dispensation structures;

selectively causing said vehicles to be diverted from said transit lane into one of a plurality of driveways sequentially arranged adjacent said transit lane and adjacent to at least one of said collection stations and each driveway defining a circulatory drive-thru periphery situated along the driver's side of said vehicles with each driveway having a center of curvature situated nearer to the passenger's side of a given vehicle than to the driver's side;

causing said diverted vehicles to move in a circulatory traffic flow pattern with the driver's side of said diverted vehicles situated along said drive-thru periphery of said driveway, thereby arriving at said collection station corresponding to one of said service dispensing structures positioned along said driveway with said driver's side of said vehicle adjacent to said collection station; and causing said diverted vehicles after passing said collection station to re-enter said transit lane, whereby each of said diverted vehicles is caused to complete said circulatory pattern through crossing over a portion of said driveway that it has previously traversed.

35. A method as recited in claim 34, wherein each of said service dispensing structures is a restaurant.

* * * * *

UNITED STATES PATENT AND TRADEMARK OFFICE

CERTIFICATE OF CORRECTION

PATENT NO. : 4,884,662

DATED : December 5, 1989

INVENTOR(S) : David Cho and Richard M. Steckler

It is certified that error appears in the above-identified patent and that said Letters Patent is hereby corrected as shown below:

Column 4,lines 67-68,cancel "eastern most" and insert --easternmost--.

Column 10, line 29 after "driver's" and before "," insert --side--.

Signed and Sealed this

First Day of January, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,884,662

DATED : December 5, 1989

INVENTOR(S) : David Cho and Richard M. Steckler

It is certified that error appears in the above-identified patent and that said Letters Patent is hereby corrected as shown below:

Column 12, line 53, cancel "lift" and insert --left--.

Signed and Sealed this

Nineteenth Day of February, 1991

*Attest:*

HARRY F. MANBECK, JR.

*Attesting Officer*

*Commissioner of Patents and Trademarks*